US008394205B2

(12) United States Patent
MacNeil

(10) Patent No.: US 8,394,205 B2
(45) Date of Patent: Mar. 12, 2013

(54) PIPE SCARIFYING SYSTEM AND METHOD

(75) Inventor: Gerard MacNeil, Surrey (CA)

(73) Assignee: Mac & Mac Hydrodemolition Inc., Surrey (CA)

( * ) Notice: Subject to any disclaimer, the term of this patent is extended or adjusted under 35 U.S.C. 154(b) by 460 days.

(21) Appl. No.: 12/576,975

(22) Filed: Oct. 9, 2009

(65) Prior Publication Data

US 2010/0192982 A1 Aug. 5, 2010

Related U.S. Application Data

(60) Provisional application No. 61/149,228, filed on Feb. 2, 2009.

(51) Int. Cl.
*B08B 9/00* (2006.01)

(52) U.S. Cl. ..... 134/166 C; 15/104.05; 15/236.01

(58) Field of Classification Search ..... None
See application file for complete search history.

(56) References Cited

U.S. PATENT DOCUMENTS

| | | | | |
|---|---|---|---|---|
| 3,016,201 | A | 1/1962 | Brogden | |
| 3,833,175 | A | 9/1974 | Pulk | |
| 5,018,545 | A | 5/1991 | Wells | |
| 5,052,624 | A * | 10/1991 | Boers et al. | 239/525 |
| 5,317,782 | A | 6/1994 | Matsuura | |
| 5,522,677 | A | 6/1996 | Schlecht | |
| 5,851,580 | A | 12/1998 | Amberg | |
| 6,206,016 | B1 | 3/2001 | MacNeil | |
| 7,100,622 | B2 | 9/2006 | MacNeil | |
| 2002/0179123 | A1 * | 12/2002 | Toward et al. | 134/34 |
| 2005/0150531 | A1 * | 7/2005 | MacNeil et al. | 134/198 |
| 2007/0052241 | A1 * | 3/2007 | Pacy | 290/1 R |

FOREIGN PATENT DOCUMENTS

| | | |
|---|---|---|
| FR | 2720667 | 6/1994 |
| FR | 2744469 | 2/1996 |

* cited by examiner

*Primary Examiner* — Eric Golightly

(57) ABSTRACT

The invention disclosed and claimed herein relates to a subterranean pipe tractor for moving and controlling a pipe scarifier. The subterranean pipe tractor comprises a scarifier connector that reversibly connects a scarifier to the pipe tractor; a drive mechanism for propelling the scarifier through the pipe when the scarifier is connected to the pipe tractor; and a power source that powers the drive mechanism. The power source of the pipe tractor may be an on-board power source or an external power source. The pipe tractor may include a hydraulic pump and an on-board electric generator powered by the power source. The subterranean pipe tractor may include local controls for controlling local functions and remote controls used to control remote components, such as a high-pressure fluid source. The subterranean pipe tractor may optionally include a scarifier lift mechanism for lifting one end of the scarifier.

5 Claims, 3 Drawing Sheets

PIPE SCARIFYING SYSTEM AND METHOD

REFERENCE TO RELATED APPLICATIONS

This application claims the benefit of U.S. Provisional Patent Application 61/149,228 filed on Feb. 2, 2009 by Vernon G. Bose, et al.

FIELD OF THE INVENTION

This invention relates to devices used to scarify and clean the interior surfaces of pipes, tunnels, passageways, and the like.

BACKGROUND

In our previous patents, for instance, U.S. Pat. Nos. 7,100,622 and 6,206,016, we described various devices used to scarify pipes, passageways, and such. These devices are referred to in the art as "scarifying devices" or just "scarifiers." Such previously described scarifiers are self-propelled or mounted on a vehicle so that the scarifier and its means of propulsion are integrated into one unit. While self-propelled scarifiers have some advantages, they also have a number of disadvantages. For instance, their size and mass make them difficult to transport and to position in the pipe being scarified. Here we disclose a novel scarifying system including a stand-alone pipe tractor that propels a scarifier along the pipe and also provides power and control functions.

BRIEF DESCRIPTION OF THE INVENTION in one favored embodiment the invention comprises a subterranean pipe tractor for propelling a scarifier in a pipe. The subterranean pipe tractor comprises a scarifier connector that reversibly connects the scarifier to the subterranean pipe tractor; a drive mechanism for propelling the scarifier through the pipe when the scarifier is connected to the subterranean pipe tractor; and a power source that powers the drive mechanism. The scarifier connector may be a ball-hitch, pin-hitch, pintle type coupling, or any other reversible mechanism used to connect towed objects to towing vehicles.

The subterranean pipe tractor may optionally include a junction and a conduit such that the conduit that couples a high-pressure fluid source to a nozzle on the scarifier by means of the junction. The conduit may comprise a primary high-pressure fluid hose that can be reversibly coupled to the junction, and a secondary high-pressure fluid hose that couples the junction to the nozzle on the scarifier. The conduit thus connects a high-pressure fluid source to the nozzle. The term "high-pressure" used in the disclosure and claims means that the fluid is under sufficient pressure to cause scarification of the pipe surface when the fluid is emitted from the nozzle.

The power source of the subterranean pipe tractor may be an on-board power source; for instance, a diesel motor. Alternatively, the power source may be an external power source such as an electric generator or an electric mains.

The subterranean pipe tractor may include a hydraulic pump, which may actuate one or more elements such as the drive mechanism, a scarifier lift mechanism that lifts an end of the scarifier, and a nozzle movement actuator.

The subterranean pipe tractor may include an on-board electric generator powered by the power source. The generator actuates electric components of the pipe tractor such as hydraulic pumps, electric lights, and controls and valves, as well as electric components of the scarifier such as nozzle movement actuators.

The subterranean pipe tractor may include local controls for controlling functions of the subterranean pipe tractor and scarifier. The subterranean pipe tractor optionally may have remote controls used to control remote components operating on the surface such as a high-pressure fluid source.

The scarifier may have one or more wheels at one end, and the subterranean pipe tractor may optionally include a scarifier lift mechanism for lifting the other end of the scarifier when moving the scarifier.

Another favored embodiment of the invention is a pipe scarifying system for scarifying a pipe. The pipe scarifying system comprises: the subterranean pipe tractor described above; a scarifier with at least one nozzle; a high-pressure fluid source; and, a conduit connecting the high-pressure fluid source to the nozzle.

The conduit of the pipe scarifying system may comprise a junction and a primary high-pressure hose that couples the high-pressure fluid source to the junction. A secondary high-pressure hose connects the junction to the nozzle, so that the high-pressure source is connected to the nozzle. The conduit may include valves and pressure gauges, as are known in the field, and the valves and/or gauges may form the junction.

In the pipe scarifying system embodiment the scantier may optionally be of a type that has one or more wheels at one end of the scarifier, in which case the subterranean pipe tractor may have a scarifier lift mechanism for lifting a second end of the scarifier in order to facility moving of the scarifier by the pipe tractor.

Another favored embodiment of the invention is a method of using the scarifying system described above to scarify a portion of a pipe. The method may include the following steps in an order that is most convenient for a particular job: (a) placing the scarifier and the subterranean pipe tractor in the pipe; (b) connecting the scarifier to the subterranean pipe tractor; (c) connecting the high-pressure fluid source to the nozzle on the scarifier; (d) placing the nozzle adjacent a pipe surface to be scarified; (e) actuating the high-pressure fluid source, whereby high-pressure fluid is emitted from the nozzle onto the pipe surface; (f) moving the nozzle with respect to the pipe surface; (g) using the subterranean pipe tractor to move the scarifier along the pipe; and, (h) repeating the foregoing steps until the portion of the pipe to be scarified has been scarified.

Moving the scarifier along the pipe may be done continuously or in a saltatory manner. Saltatory scarifying is accomplished by de-activating the source of high-pressure fluid after a first section of pipe is scarified; moving the scarifier to a next position in the pipe with the pipe tractor; and, actuating the high-pressure source again in order to scarify the next section. The stepwise process is repeated until the entire portion of the pipe is scarified.

BRIEF DESCRIPTION OF THE DRAWINGS

In the drawings identical reference numbers are employed to identify identical or analogous elements. The sizes and relative positions of the elements in the drawings are not necessarily to scale. Identical elements of a plurality are generally given the same reference numeral.

DETAILED DESCRIPTION OF THE INVENTION

1. Structure

Figure 1:
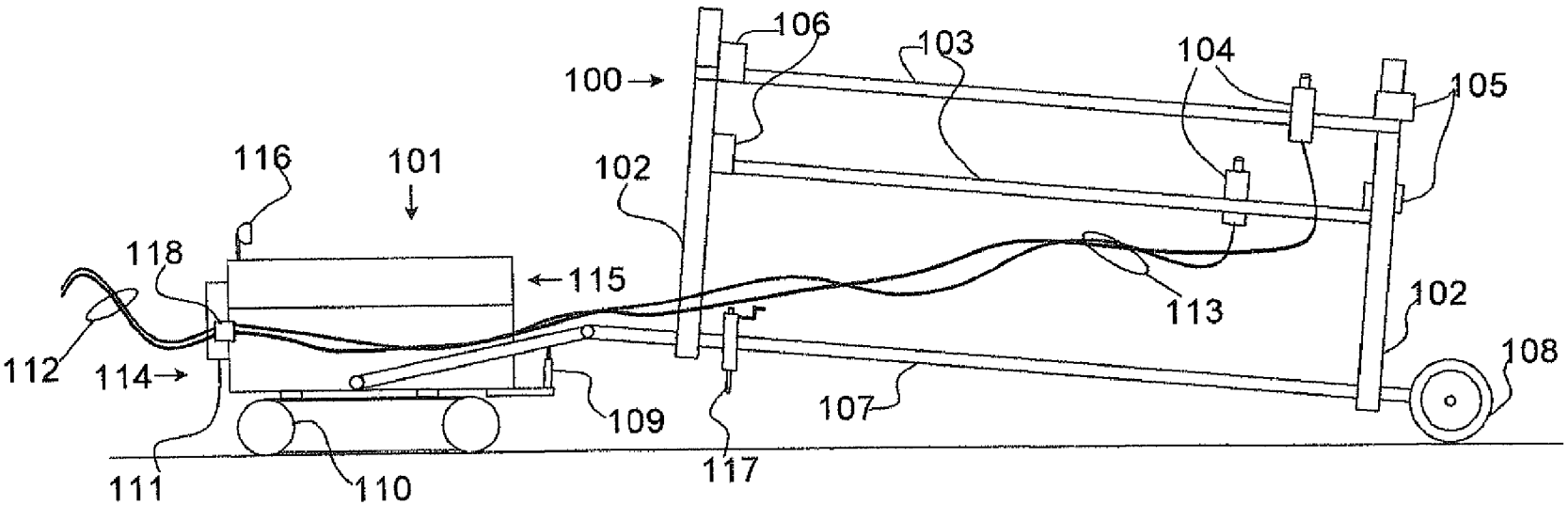
FIG. 1 is a side elevation of the pipe tractor connected to the scarifier in a raised configuration.

FIG. 1 shows the major components of the system, namely, a movable subterranean scarifier 100 attached to a subterranean pipe tractor 101. These components are referred to as "subterranean" because they normally operate beneath the surface; i.e., in a pipe. The term "subterranean" refers to having the capability of operating within a pipe with respect to such characteristics as size, limited or no carbon monoxide emissions, and the like. Unless otherwise noted, "pipe tractor" and "scarifier" used herein refer to subterranean pipe tractors and scarifiers, respectively.

The term "pipe" is used herein to include tunnels, mines or other underground conduits or passageways that are amenable to scarifying by the invention. The term "scarifier" refers to and is limited to device for cleaning and/or scarifying surfaces that can be moved within a pipe by a pipe tractor of the type disclosed herein. The term "moved" or "moveable" with respect to a scarifier refers to the movement of the scarifier within a pipe produced by a pipe tractor, wherein the movement is substantially rectilinear along the longitudinal axis of the pipe. The term "pipe tractor" as used herein refers to a device that is separable from a scarifier but that can be connected to a scarifier and can move the scarifier within the pipe. These definitions include their grammatical congeners and apply throughout the disclosure and claims unless otherwise indicated.

Figure 2:
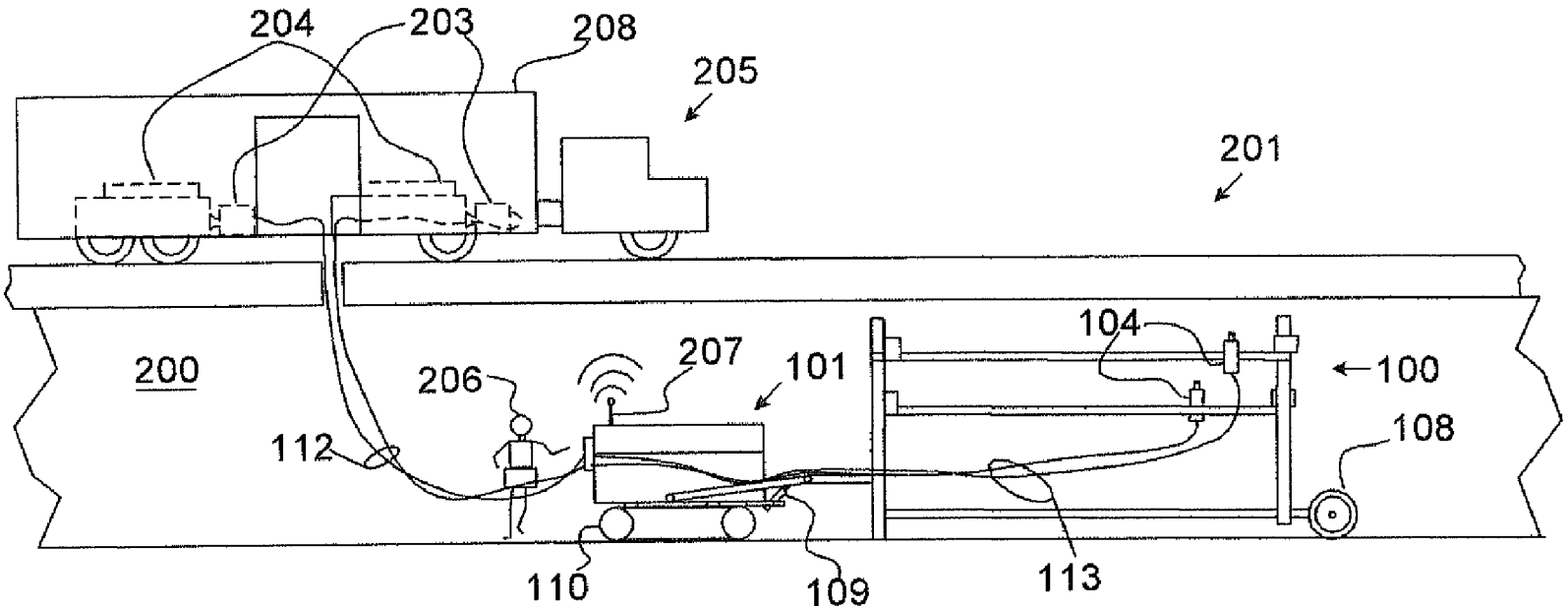
FIG. 2 is a side elevation of the system in use showing surface and subterranean components.

In the art, various types of scarifiers are known having a number of mechanisms for moving the nozzles of a scarifier with respect to a surface, for instance, moveable arms with nozzles at the ends, rotating nozzle heads, and pivoting nozzle assemblies. The present invention is not limited to any particular type of scarifier or nozzles other than the scarifier must be of a type that can be moved within a pipe by a pipe tractor as disclosed and claimed herein. Although the invention relates to a wide variety of scarifiers, this disclosure focuses on one type as shown in FIG. 1 and FIG. 2. Scarifier 100 has two substantially vertical arcuate tracks 102, shown side-on in the figures. Movably attached to the arcuate tracks are beams 103. When the scarifier is in position for operation, the beams are substantially horizontal and aligned parallel to the longitudinal axis of the pipe. The beams are able to move along the arc of the arcuate tracks by means of nozzle movement actuators referred to herein as nozzle lift actuators 105. Movably attached to the beams are nozzles 104. The nozzles are able to move back and forth along the length of the beams by means of nozzle movement actuators referred to herein as nozzle travel actuators 106. Thus, the nozzles are movable with respect to the pipe surface. The nozzle lift actuators and travel actuators can take various forms such as chain and sprocket devices, worm gears, cable and reel devices and can be powered by, for instance, electric or hydraulic motors.

The scarifier includes a chassis 107. The chassis is carried on one end by a pair of wheels 108 or a carriage. At the other end the chassis is removably attached to the pipe tractor by means of a scarifier connector, such as a hitch. The scarifier connector may be integrated into an optional scarifier lift mechanism 109, which is operable to raise and lower the end of the scarifier adjacent the pipe tractor. FIG. 1 shows the scarifier in the raised configuration. FIG. 2 shows the scarifier in the lowered configuration. While in the lowered configuration, the scarifier is operable for scarifying the pipe. While in the raised configuration the scarifier is operable for being moved along the pipe on the wheels or carriage.

In the embodiment shown in FIG. 1, the pipe tractor is propelled by a drive mechanism in the form of a pair of opposed rotating endless belts or tracks 110. The drive mechanism may be of any type capable of propelling the pipe tractor in the pipe.

The pipe tractor has a front end 115 and an aft end 114. The scarifier is attached to front end 115. Scarifier lift mechanism 109 for lifting one end of the scarifier is attached to or mounted on the front end of the pipe tractor. We currently prefer that the scarifier lift mechanism be hydraulic, but other lift means such as sprocket and chain, worm gear, and the like are within the scope of the invention.

The aft end of the pipe tractor includes a control panel 111 that includes gauges for monitoring various parameters and controls for controlling various functions of the pipe tractor and scarifier, as described below. In a preferred embodiment of the pipe tractor, external inputs to the pipe tractor arrive at the aft end. These inputs include 1) high pressure fluid supplied by primary high pressure hoses 112 connected to junction 118 mounted on the pipe tractor, and, optionally, 2) electric current supplied by an electric cable (not shown).

Secondary high-pressure hoses 113 connect the junction 118 to the nozzles 104. As used herein, the term "junction" refers to any device for connecting the primary high-pressure hose or hoses to the pipe tractor so that the high-pressure fluid is conducted to the secondary high-pressure hose or hoses. The junction may be a direct coupling between the primary and secondary hoses or there may be an intermediary device, such as a junction box, pressure gauge, or a valve. In terms of operation, the primary high-pressure hose is generally connected to the junction prior to operation and disconnected from the junction after operation while the secondary hose remains connected to the junction.

In one preferred embodiment, the pipe tractor includes its own on-board electrical system, including an on-board generator, an on-board motor to power the generator, and on-board rechargeable batteries for storing current supplied by the generator. The on-board motor also powers the drive mechanism. In other preferred embodiments, some or all of the electrical requirements of the pipe tractor and scarifier may be met by electric current supplied from the surface through an electrical cable (not shown). The pipe tractor and/or the scarifier may optionally be fitted with one or more lights 116 powered by external power or by an on-board generator system.

In one preferred embodiment the pipe tractor includes an on-board hydraulic system the pumps of which are powered by an on-board electric generator or by electric supplied from the surface. The hydraulic system, in turn, powers the lift 109 and/or the drive mechanism, such as tracks 110.

Referring to FIG. 2 in conjunction with FIG. 1, one preferred embodiment of the system of the invention is shown in use within pipe 200 that is beneath the surface 201. The scarifier 100 is attached to the pipe tractor 101 by means of the scarifier connector on the scarifier lift mechanism 109. A surface unit 205 on the surface is preferably a tractor-trailer rig employing a closed trailer 208 adapted to carry high-pressure pumps 203 that are powered by motors 204. These high-pressure pumps supply the high-pressure fluid used to scarify the walls of pipe 200. FIG. 2 shows two such motor/pump combinations as part of the surface unit, but the number can be greater or less than two depending on the job requirements and the type of scarifier. Generally, each high-pressure pump supplies high-pressure fluid to one nozzle 104. Primary high pressure hoses 112 connect the pumps to the pipe tractor by means of the junction 118. The junction is in fluid communication with or may comprise high pressure gauges (not shown) that allow the operator 206 to monitor the pressure of the fluid. Secondary high-pressure hoses 113 connect the high-pressure junction to the nozzles 104.

Optionally, the operator 206 controls flow of the high-pressure fluid to the nozzles by means of a communication link 207 to the surface unit 205. This communication link can be wireless, as shown, or can be made via cable. By remotely controlling the remote high-pressure pumps in the surface unit, the operator also controls the nozzles' output. Typically, the motors are pre-set so that when they are activated they run at a speed that will produce the desired pump output; for instance, 20,000 p.s.i. The operator 206 also controls the scarifier lift mechanism 109, drive mechanism 110, nozzle lift actuator 105 and nozzle travel actuator 106, and lights 116. Thus, one operator controls virtually the entire scarifying process, although assistance may be required on the surface to maintain the pumps.

Figure 3:
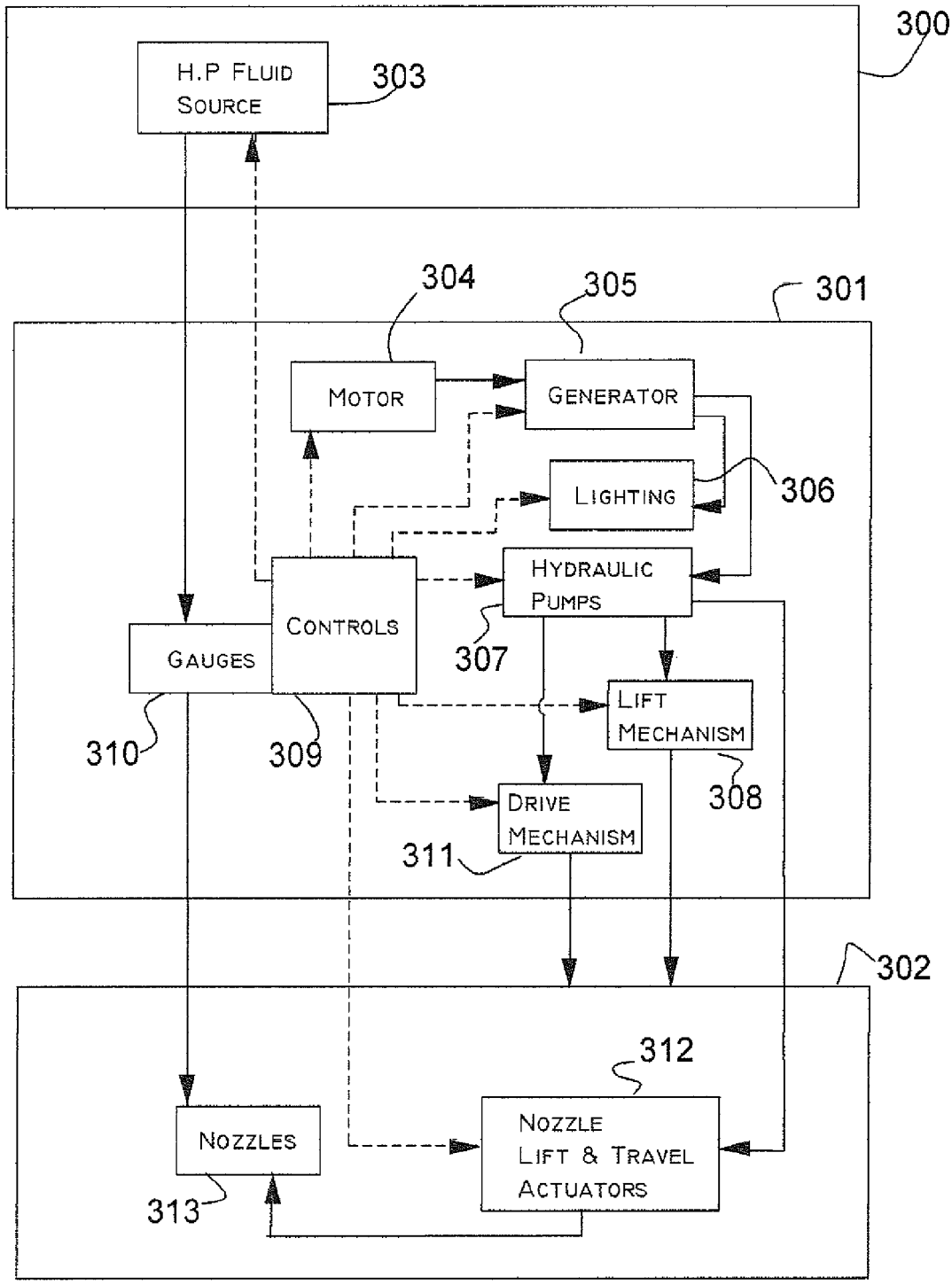
FIG. 3 is a block flow diagram of the control process and power flows of the system.

FIG. 3 shows the flow of control signals, power, and high-pressure fluid with respect to a preferred embodiment of the system. In the schematic of FIG. 3, the surface unit is represented as block 300, the scarifier is represented as block 302, and the pipe tractor as block 301. The pipe tractor 301 includes a number of interacting elements as well as elements that interact with the surface unit 300 and the scarifier 302.

The controls are collectively represented as block 309. The various control lines are represented by dashed lines in FIG. 3. The controls 309 are used to control the motor 304, the generator 305, the lights 306, the hydraulic pumps 307, the scarifier lift mechanism 308, the drive mechanism 311, the nozzle movement actuators 312, and the high-pressure fluid source 303. The controls will typically be mounted on a control panel. A detailed description of the control elements need not be provided here inasmuch as the electrical switches, servo-mechanisms, valves, and/or levers that are required are well known in the art. Having read and understood this disclosure the choice of individual components are ad hoc design decisions for those of skill in the art having read and carefully considered this disclosure.

In the preferred embodiment, the motor 304 on board the pipe tractor drives generator 305, which supplies electric current to actuate the hydraulic pumps 307 by which the scarifier lift mechanism 308 and the drive mechanism 311 are powered. Hydraulic pumps also power the nozzle movement actuators 312 on the scarifier 302. In one preferred embodiment the on-board motor 304 is a 50 h.p. Kubota® diesel motor adapted and rated for subterranean use. The control panel activates a remote communications link to control the motors and high-pressure pumps 303 located in the surface unit 300.

The generator also powers lighting system 306. The lights may be located on the pipe tractor, or on the scarifier, or both.

2. Method of Use

Referring again to FIG. 1 and FIG. 2, the system is used to scarify a portion of a pipe as follows: The pipe tractor 101 and scarifier 100 are lowered or otherwise introduced into the pipe. The pipe tractor is connected to the scarifier. This is done by means of a reversible connection mechanism such as a hitch, which may be integrated with the scarifier lift mechanism 109.

The surface unit 205 is placed in position adjacent an access hole. The high-pressure fluid source 203/204 is connected to the nozzles 104. This may be done by connecting primary high-pressure hoses 112 from the high-pressure pumps 203 to the junction 118, which may be conveniently located on or near the control panel 111. Secondary high-pressure hoses 113, which normally remain connected to or integrated with the junction 118, are connected to the nozzles 104 thereby establishing a fluid communication between the high-pressure fluid source and the nozzle.

To place the system in operation, the motor on-board the pipe tractor is activated, which drives the on-board generator to generate electric current for powering the hydraulics, controls, and lights. A communications link from the control panel to the surface unit is activated. The hydraulic scarifier lift mechanism 109 is activated to raise the end of the scarifier. The drive mechanism 110 is activated to move the scarifier to a first position in the pipe, and the end of the scarifier is lowered. The pipe tractor can either push or pull the scarifier through the pipe, depending on the job specifications and the preferences of the operator. If the scarifier is the kind that has wheels at both ends, or has a glide-sled, for instance, then the lifting operation may not be required.

The nozzles are positioned so that they are adjacent the surface of the pipe so that the surface will be scarified when the high-pressure fluid is emitted from the nozzle. The high-pressure fluid pumps 203 are then actuated. In the embodiment shown in FIGS. 1 and 2, this means sending a signal by means of the communications link 207 by the operator 206 in the pipe to the motors 204 on the surface, which power the high-pressure pumps 203. High-pressure fluid is then transmitted from the high-pressure fluid source to the nozzles, and emitted from the nozzles against the pipe surface, thus scarifying the surface. The nozzle movement actuators, lift actuator 105 and travel actuator 106. are actuated in a synchronized manner to move the nozzles with respect to the pipe surface, back and forth along the horizontal beams and about the arc of the vertical arcuate tracks. The inner surface of the pipe is thereby scarified for substantially the length of the scarifier.

The movement of the scarifier through the pipe may be continuous or it may be saltatory, depending on the type of scarifier used. In saltatory movement, when the pipe surface adjacent the scarifier has been adequately scarified at the initial position of the scarifier in the pipe, the high-pressure fluid pumps are de-activated by means of the communications link and the high-pressure fluid ceases being emitted from the nozzles. "De-activated" means that the pumps are turned off, or that valves are closed, or flow is diverted from the nozzles by other means. The pipe tractor is then used to move the scarifier along the pipe to a next position. It is most convenient to move the scarifier a distance substantially equal to the length of the scarifier. The high pressure fluid pumps are actuated again and the new section of the surface is scarified. This stop-and-go process is repeated until the entire portion of the pipe to be scarified is completed.

In continuous scarifying, it is possible to leave the high pressure fluid pumps running throughout the process and move the scarifier steadily along the pipe with the pipe tractor. For instance, if the scarifier is the type in which the nozzle swings to and fro at the end of a pivot arm, it is not necessary to stop the high-pressure fluid pumps, re-position the scarifier, and then re-activate the pumps.

Details, Refinements, and Variations

The scarifier disclosed above has wheels only at one end, requiring the opposite end to be lifted by the pipe tractor in order to be moved. In another preferred embodiment, the scarifier rides on wheels attached at both ends so that the scarifier lift mechanism 109 and lifting operation are dispensed with. The pipe tractor is connected to the scarifier and merely propels the scarifier on its wheels.

Similarly, the scarifier can be mounted on a pair of opposed endless tracks, or on a sled-type device. Regardless of the device upon which the scarifier rides, one or more retractable legs 117 for stabilizing the scarifier during operation may be provided. These retractable legs may be operated by hand cranks or by electric motors or servo-mechanisms. If the leg retraction mechanism is electric, then it may be powered by generator 306 and controlled by the operator by employing controls 309.

An alternative preferred embodiment of the scarifying system discussed above is to dispense with the on-board motor 304 and the generator 305 and provide electric power to the pipe tractor by means of cables connected to an electric source, for instance a generator located on the surface, or mains power. The use of external electric power can also supplant the hydraulic system 307 and power an electric scarifier lift mechanism 308 and electric drive mechanism 311 directly. Alternatively, other sources of power can be exploited by the invention including, by way of example, emerging compressed air technologies.

The on-board electrical system of the pipe tractor may include one or more batteries for storing electrical current generated by the on-board generator or from the surface. The choice of the size, number, and type of batteries are design considerations that will depend upon the user's particular needs and resources.

Our invention has been described above with respect to a particular type of scarifier. However, other types of scarifiers are readily adaptable for use with this system. For instance, our U.S. Pat. No. 6,206,016 discloses a number of self-propelled scarifiers that can be easily modified to be used with a pipe tractor of the type disclosed herein instead of being propelled by a self-propelled mechanism.

Although the drive mechanism 311 of the pipe tractor is disclosed above as paired tracks 110, alternative drive mechanisms are easily adapted to the invention. For instance, the pipe tractor may comprise a chassis with a plurality of wheels that are driven by individually by hydraulic or electric motors or by a single motor connected to one or more wheels by a transmission.

The communications link from the operator to the surface described above is a simple link to activate the motors and hydraulic pumps. More complex communications systems are within the scope of the invention. For instance, the communication link may include voice communication capabilities with assistants on the surface or control by surface personnel of functions performed by the pipe tractor in the pipe.

SUMMARY

From the foregoing description, the novelty, utility, and means of using our invention will be readily apprehended. It is to be understood that our invention is not limited to the embodiments disclosed above but encompasses any and all embodiments lying within the scope of the claims that follow and the foregoing disclosures, including the figures.

I claim:

1. A pipe scarifying system for scarifying a pipe surface, the system comprising:

a. a freestanding scarifier having a nozzle, and a first end having at least one wheel to support the scarifier, and a second end;

b. a subterranean pipe tractor for propelling the scarifier along a pipe, the subterranean pipe tractor comprising:

i. a scarifier connector that releasably connects the scarifier to the subterranean pipe tractor;

ii. a drive mechanism adapted to propel the subterranean pipe tractor through the pipe when the scarifier is connected to the subterranean pipe tractor;

iii. a power source that powers the drive mechanism; and iv. a scarifier lift mechanism for lifting the second end of the scarifier;

c. a high-pressure fluid source; and d. a conduit connecting the high-pressure fluid source to the nozzle.

2. The pipe scarifying system of claim 1, wherein said subterranean pipe tractor further comprises a remote control, wherein the remote control is used to control the high-pressure fluid source.

3. The pipe scarifying system of claim 1, wherein the subterranean pipe tractor further comprises a hydraulic pump.

4. The pipe scarifying system of claim 3, wherein the hydraulic pump actuates at least one of said drive mechanism, a nozzle movement actuator, and the scarifier lift mechanism.

5. The pipe scarifying system of claim 1, wherein the conduit comprises:

a. a junction;

b. a primary high-pressure fluid hose that couples the high-pressure fluid source to the junction; and c. a secondary high-pressure hose that couples the junction to the nozzle.

* * * * *